US005500972A

United States Patent [19]

Foster

[11] Patent Number: 5,500,972

[45] Date of Patent: Mar. 26, 1996

[54] ROTATING BACK SCRUBBER

[76] Inventor: David C. Foster, 1743 Creole St., La Place, La. 70068

[21] Appl. No.: 334,943

[22] Filed: Nov. 7, 1994

[51] Int. Cl.[6] ..... A46B 13/02

[52] U.S. Cl. ..... 15/28

[58] Field of Search ..... 15/23, 24, 28, 15/29, 97.1, 49.1, 50.1; 601/112, 114

[56] References Cited

U.S. PATENT DOCUMENTS 2,142,933 1/1939 Bickford ..... 15/49.1
3,775,800 12/1973 Veneziani ..... 15/28
4,203,431 5/1980 Abura et al. ..... 15/28
5,385,532 1/1995 Shyu ..... 15/29

*Primary Examiner*—Edward L. Roberts, Jr.

[57] ABSTRACT

A scrubber for cleaning a dorsal portion of an individual. The inventive device includes a plurality of cylindrical brushes each symmetrically oriented about an individual axis. The brushes are coupled to rotating assembly for spinning each brush about its individual axis and simultaneously rotating the brushes about a common center axis. The handle extends from the rotating assembly to permit manual manipulation of the device during a bathing procedure.

3 Claims, 3 Drawing Sheets

ROTATING BACK SCRUBBER

BACKGROUND OF THE INVENTION

1. Field of the Invention

The present invention relates to scrubbing devices and more particularly pertains to a rotating back scrubber for cleaning a dorsal portion of an individual.

2. Description of the Prior Art

The use of scrubbing devices is known in the prior art. More specifically, scrubbing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art scrubbing devices include German Patent 680,862; French Patent 1,107,625; U.S. Pat. Nos. 4,020,519; 4,696,068; and 4,014,051.

While these devices fulfill their respective, particular objectives and requirements, the aforementioned patents do not disclose a rotating back scrubber for cleaning a dorsal portion of an individual which includes a plurality of cylindrical brushes each symmetrically oriented about an individual axis, a rotating assembly mounting each of the cylindrical brushes for spinning each brush about its individual axis and simultaneously rotating the brushes about a common center axis, and a handle extending from the rotating assembly to permit manual manipulation of the device.

In these respects, the rotating back scrubber according to the present invention substantially departs from the conventional concepts and designs of the prior art, and in so doing provides an apparatus primarily developed for the purpose of cleaning a dorsal portion of an individual.

SUMMARY OF THE INVENTION

In view of the foregoing disadvantages inherent in the known types of scrubbing devices now present in the prior art, the present invention provides a new rotating back scrubber construction wherein the same can be utilized for cleaning and scrubbing the back of an individual. As such, the general purpose of the present invention, which will be described subsequently in greater detail, is to provide a new rotating back scrubber apparatus and method which has many of the advantages of the scrubbing devices mentioned heretofore and many novel features that result in a rotating back scrubber which is not anticipated, rendered obvious, suggested, or even implied by any of the prior art scrubbing devices, either alone or in any combination thereof.

To attain this, the present invention generally comprises a scrubber for cleaning a dorsal portion of an individual. The inventive device includes a plurality of cylindrical brushes each symmetrically oriented about an individual axis. The brushes are coupled to rotating assembly for spinning each brush about its individual axis and simultaneously rotating the brushes about a common center axis. The handle extends from the rotating assembly to permit manual manipulation of the device during a bathing procedure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rotating back scrubber apparatus and method which has many of the advantages of the scrubbing devices mentioned heretofore and many novel features that result in a rotating back scrubber which is not anticipated, rendered obvious, suggested, or even implied by any of the prior art scrubbing devices, either alone or in any combination thereof.

It is another object of the present invention to provide a new rotating back scrubber which may be easily and efficiently manufactured and marketed.

It is a further object of the present invention to provide a new rotating back scrubber which is of a durable and reliable construction.

An even further object of the present invention is to provide a new rotating back scrubber which is susceptible of a low cost of manufacture with regard to both materials and labor, and which accordingly is then susceptible of low prices of sale to the consuming public, thereby making such rotating back scrubbers economically available to the buying public.

Still yet another object of the present invention is to provide a new rotating back scrubber which provides in the apparatuses and methods of the prior art some of the advantages thereof, while simultaneously overcoming some of the disadvantages normally associated therewith.

Still another object of the present invention is to provide a new rotating back scrubber for cleaning a dorsal portion of an individual.

Yet another object of the present invention is to provide a new rotating back scrubber which includes a plurality of cylindrical brushes each symmetrically oriented about an individual axis, a rotating assembly mounting each of the cylindrical brushes for spinning each brush about its individual axis and simultaneously rotating the brushes about a common center axis, and a handle extending from the rotating assembly to permit manual manipulation of the device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
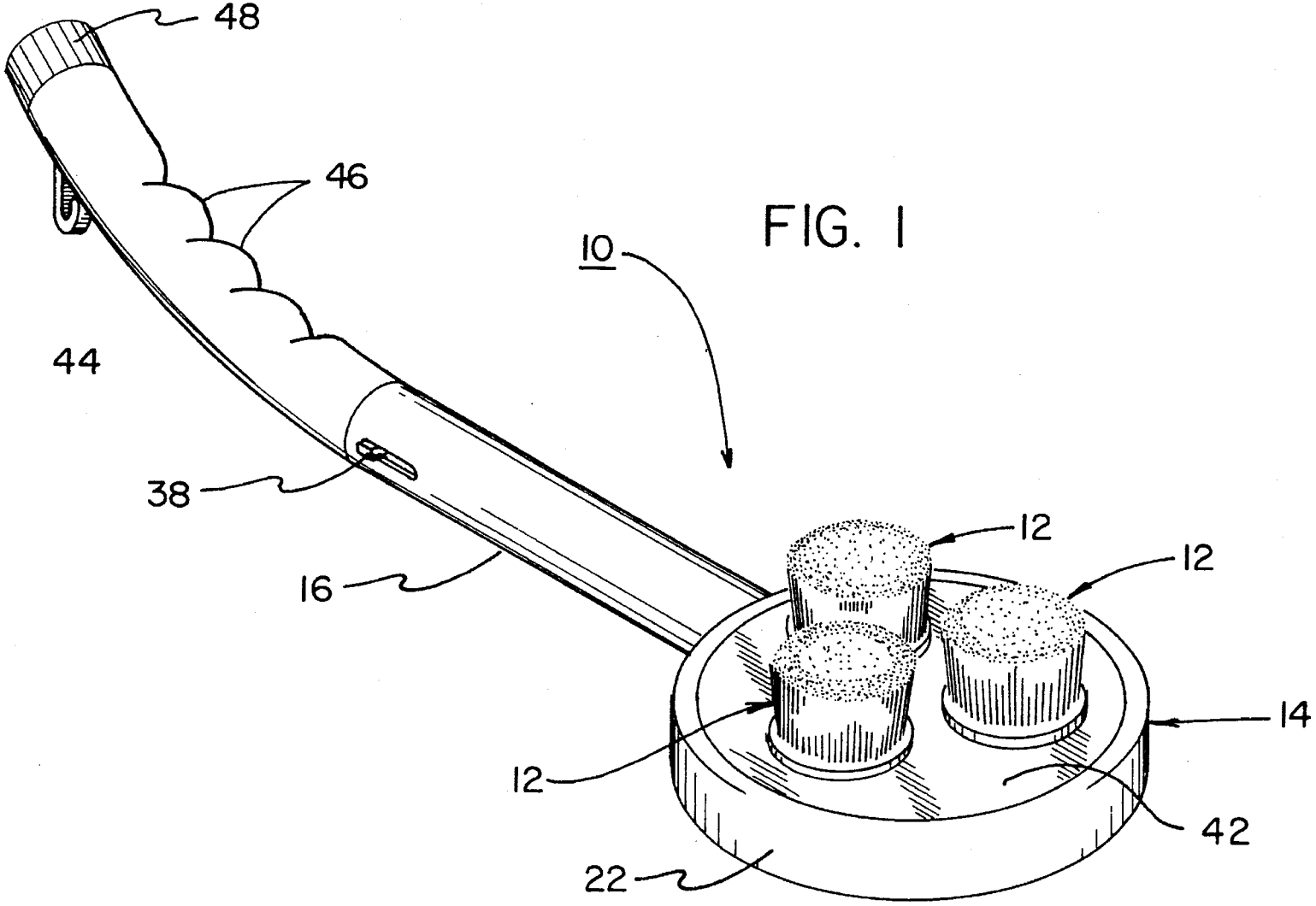
FIG. 1 is an isometric illustration of a rotating back scrubber according to the present invention.

With reference now to the drawings, and in particular to FIGS. 1–5 thereof, a new rotating back scrubber embodying the principles and concepts of the present invention and generally designated by the reference numeral 10 will be described.

More specifically, it will be noted that the rotating back scrubber 10 comprises a plurality of cylindrical brushes 12 each being symmetrically oriented about an individual axis extending through a center thereof. Each of the cylindrical brushes 12 is coupled to a rotating means 14 for spinning each brush 12 about the individual axis thereof and simultaneously rotating the brushes about a common center axis from which each of the cylindrical brushes is equally and radially spaced. An elongated handle 16 is coupled to the rotating means 14 and permits manual manipulation of the device 10 during a bathing procedure to effect cleaning of an individual's back or dorsal portion.

As best illustrated in FIGS. 2 through 5, it can be shown that each of the cylindrical brushes 12 comprises a brush gear 18 having a plurality of bristles 20 extending therefrom. Each of the brush gears 18 is rotatably coupled to the rotating means 14 in a manner which will subsequently be described in more detail.

Figure 4:
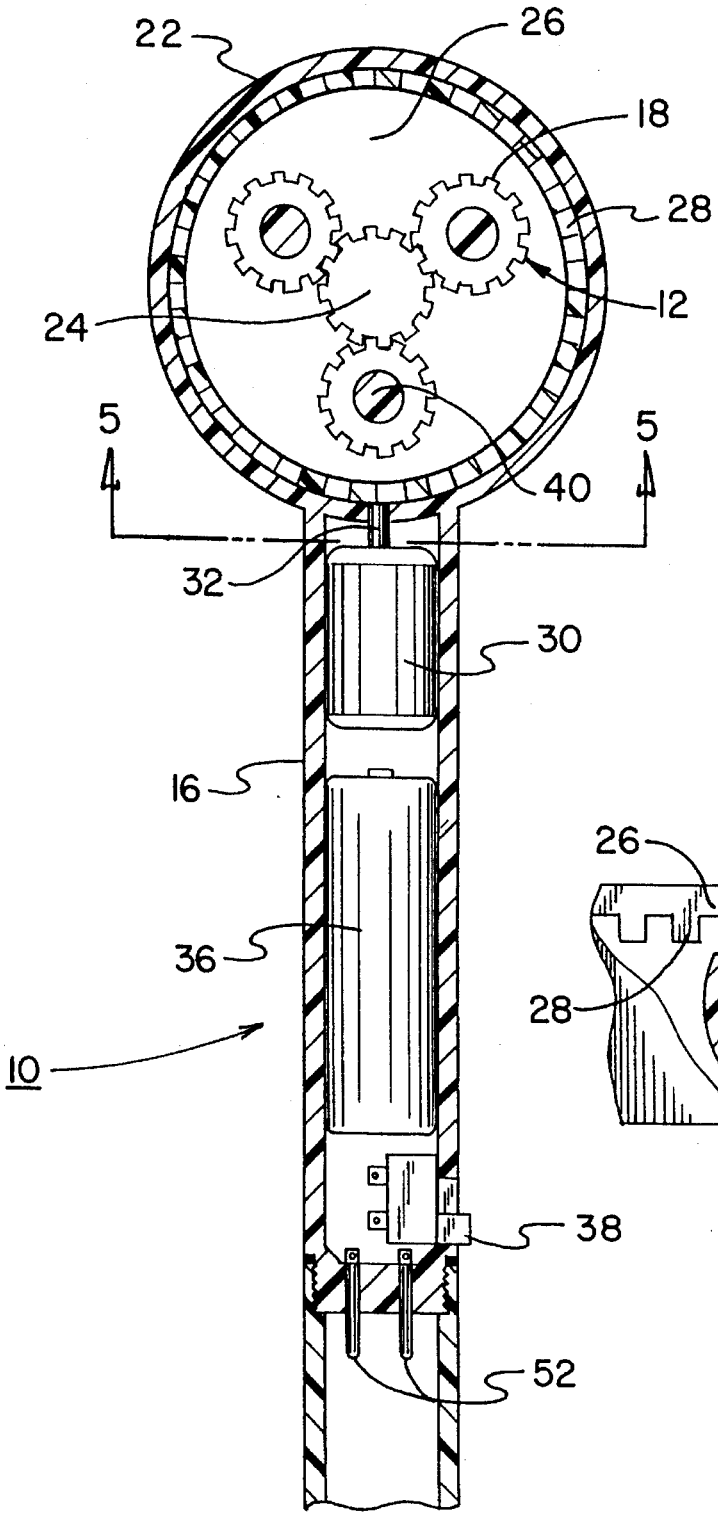
FIG. 4 is a cross sectional view taken along line 4—4 of FIG. 3.
Figure 5:
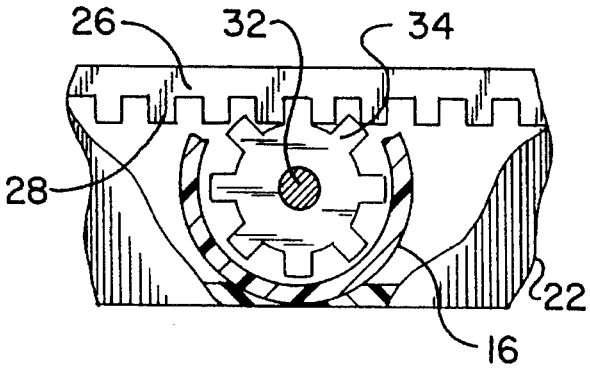
FIG. 5 is a further cross sectional view taken along line 5—5 of FIG. 4.

With continuing reference to FIGS. 4 and 5, it can be shown that the rotating means 14 according to the present invention 10 preferably comprises a cylindrical main body 22 coupled to an upper distal end of the elongated handle 16. The cylindrical main body 22 is closed at a first end thereof by a transverse plate 23, with a fixed gear 24 concentrically positioned within the cylindrical main body 22 and projecting from an interior surface of the transverse plate. A rotating plate 26 is rotatably mounted about the fixed gear 24 by unillustrated bearings interposed between the fixed gear and the transverse 23 and includes an annular rack 28 extending about an outer perimeter thereof. A motor 30 is mounted within the elongated handle 16 and includes a motor shaft 32 projecting into an interior of the cylindrical main body 22. A motor gear 34 is mounted to the motor shaft 32 so as to rotate therewith and is positioned in mesh with the annular rack 28 of the rotating plate 26, as shown in FIG. 5. A battery 36 contained within the elongated handle 16 is electrically coupled to a switch 38 by unillustrated wires, with the switch being operable to effect energization of the motor 30 in response to an actuation of the switch by a user. By this structure, an energization of the motor 30 will rotate the motor gear 34 to cause a subsequent rotation of the rotating plate 26 about the fixed gear 24.

Figure 2:
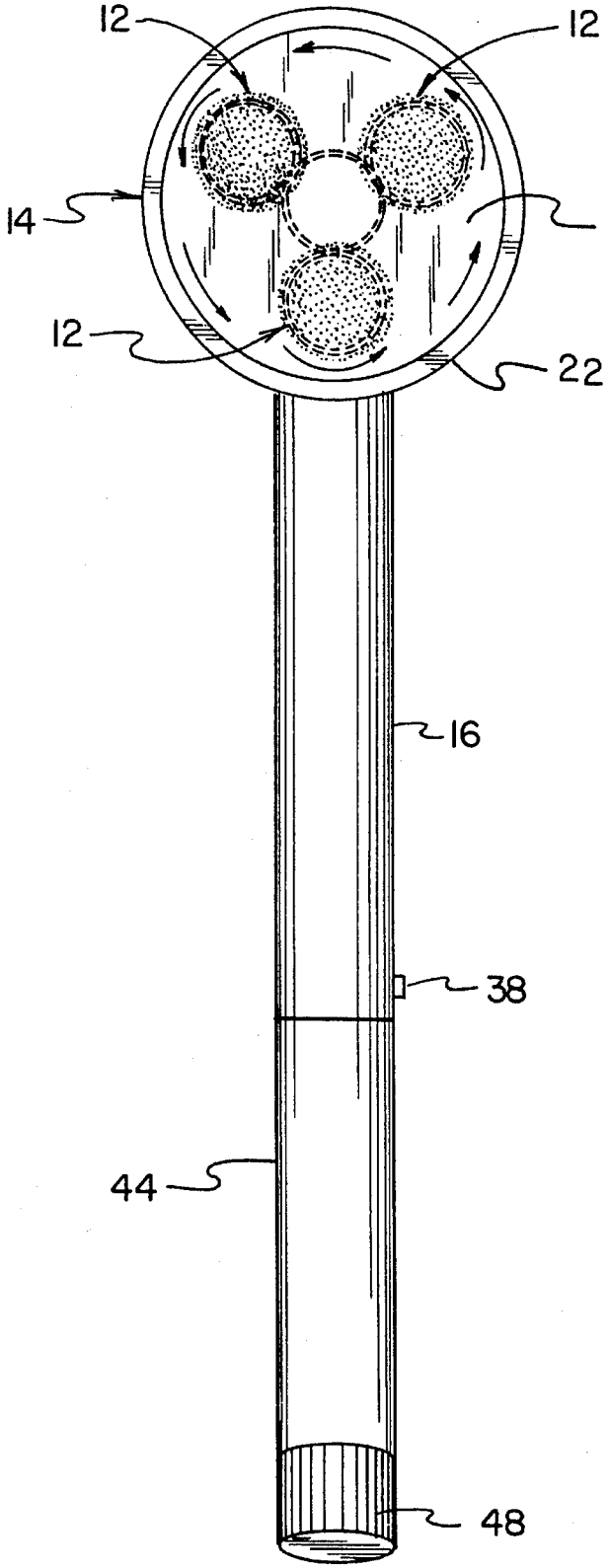
FIG. 2 is a front elevation view thereof.
Figure 3:
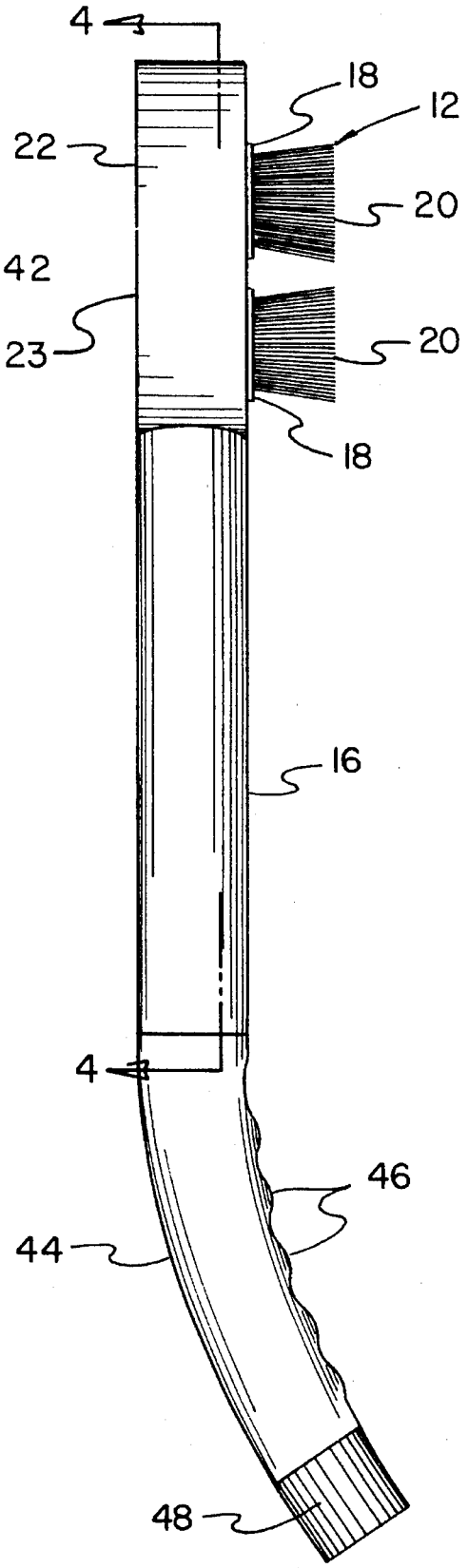
FIG. 3 is a side elevation view of the present invention.

Each of the brush gears 18 of the cylindrical brushes 12 is rotatably mounted about a rotating axle 40 projecting from the rotating plate 26 into a substantially parallel orientation relative to a common center axis directed through the fixed gear 24. The rotating axles 40 are radially spaced from the common center axis an equal distance and receive thereover an individual brush gear 18 positioned in mesh with the fixed gear 24. As shown in FIG. 2, a cover plate 42 having a plurality of through-extending apertures is positioned over the brush gears 18, with the bristles 20 of each of the cylindrical brushes 12 projecting through the apertures of the cover plate. Thus, a rotation of the rotating plate 26 through an energization of the motor 30 as described above will result in a rotation of the rotating axles 40 about the common center axis directed through the fixed gear 24. Such rotation of the rotating axles 40 will result in concurrent rotation of the brush gears 18 about the individual axis of each of the cylindrical brushes 12 directed through the associated rotating axle.

As shown in FIGS. 1 through 4, the elongated handle 16 may additionally include exterior threads which permit a rotating engagement of an arcuate grip 44 to a lower distal end thereof. The arcuate grip 44 comprises a substantially arcuate tubular member having a plurality of raised contours 46 extending longitudinally along an exterior surface thereof which preclude a slipping of the arcuate grip relative to an individual's hand. The arcuate grip includes a removable end cap 48 permitting selective entrance into an interior of the arcuate grip.

In use, the rotating back scrubber 10 according to the present invention provides both a spinning of the cylindrical brushes and a rotating of the cylindrical brushes about a common center axis to effect cleaning and scrubbing of the dorsal portion of an individual during a bathing procedure. The device 10 can be conveniently carried within a suitcase or the like and, because of the rechargeable nature of the battery 36, can be recharged by a recharging device of conventional design to permit a cordless use of the device within damp or humid environments.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotating back scrubber comprising:

a plurality of cylindrical brushes each being symmetrically oriented about an individual axis extending through a center thereof, the brushes being equally and radially spaced from a common center axis, each of the cylindrical brushes comprising a brush gear having a plurality of bristles extending therefrom;

a rotating means for spinning each brush about the individual axis thereof and simultaneously rotating the brushes about the common center axis;

and, an elongated handle coupled to the rotating means to permit manual manipulation of the back scrubber, wherein the rotating means comprises a cylindrical main body coupled to an upper distal end of the elongated handle, a transverse plate extending across an end of the cylindrical main body; a fixed gear concentrically positioned within the cylindrical main body and projecting from an interior surface of the transverse plate; a rotating plate rotatably mounted about the fixed gear, the rotating plate including an annular rack extending about an outer perimeter thereof; a motor mounted within the elongated handle and including a motor shaft projecting into an interior of the cylindrical main body; a motor gear mounted to the motor shaft so as to rotate therewith, the motor gear being positioned in mesh with the annular rack of the rotating plate; a battery contained within the elongated handle; a switch electrically coupled to both the battery and the motor for selectively effecting energization of the motor; a plurality of rotating axles projecting from the rotating plate into a substantially parallel orientation relative to a common center axis directed through the fixed gear, the rotating axles being radially spaced from the common center axis an equal distance and receiving thereover an individual brush gear positioned in mesh with the fixed gear, whereby an energization of the motor will rotate the motor gear to cause a subsequent rotation of the rotating plate about the fixed gear, with a rotation of the rotating axles about the fixed gear effecting a concurrent rotation of the brush gears about the rotating axles.

2. The rotating back scrubber of claim 1, wherein the elongated handle includes exterior threads; and further comprising an arcuate grip threadably coupled to the exterior threads of the handle, the arcuate grip comprising a substantially arcuate tubular member having a plurality of raised contours extending longitudinally along an exterior surface thereof which preclude a slipping of the arcuate grip relative to an individual's hand, the arcuate grip further including a removable end cap permitting selective entrance into an interior of the arcuate grip.

3. A rotating back scrubber comprising:

a plurality of cylindrical brushes each being symmetrically oriented about an individual axis extending through a center thereof, the brushes being equally and radially spaced from a common center axis, each of the cylindrical brushes comprising a brush gear having a plurality of bristles extending therefrom;

an elongated handle coupled to the rotating means to permit manual manipulation of the back scrubber, and, a rotating means for spinning each brush about the individual axis thereof and simultaneously rotating the brushes about the common center axis, the rotating means comprising a cylindrical main body coupled to an upper distal end of the elongated handle, a transverse plate extending across an end of the cylindrical main body; a fixed gear concentrically positioned within the cylindrical main body and projecting from an interior surface of the transverse plate; a rotating plate rotatably mounted about the fixed gear; a plurality of rotating axles projecting from the rotating plate into a substantially parallel orientation relative to a common center axis directed through the fixed gear, the rotating axles being radially spaced from the common center axis an equal distance and receiving thereover an individual brush gear positioned in mesh with the fixed gear; and an electric motor mounted within the elongated handle and positioned in mechanical communication with the rotating plate such that energization of the motor will cause a rotation of the rotating plate about the fixed gear, with a rotation of the rotating axles about the fixed gear effecting a concurrent rotation of the brush gears about the rotating axles.

* * * * *